United States Patent [19]

Bricker et al.

[11] Patent Number: 5,034,118

[45] Date of Patent: Jul. 23, 1991

[54] NON-OXIDATIVE REMOVAL OF HYDROGEN SULFIDE FROM GASEOUS, PETROCHEMICAL, AND OTHER STREAMS

[75] Inventors: Jeffery C. Bricker, Buffalo Grove; Tamotsu Imai, Mt. Prospect, both of Ill.

[73] Assignee: UOP, Des Plaines, Ill.

[21] Appl. No.: 414,802

[22] Filed: Sep. 29, 1989

[51] Int. Cl.[5] ..... C10G 27/00

[52] U.S. Cl. ..... 208/238; 208/219; 208/220; 208/223; 208/226; 208/230; 208/192; 423/219; 423/230; 585/867; 55/73

[58] Field of Search ..... 208/220, 223, 226, 230, 208/219, 238, 192, 193; 423/219, 230; 55/73; 585/867

[56] References Cited

U.S. PATENT DOCUMENTS

| | | | |
|---|---|---|---|
| 2,306,993 | 12/1942 | Lovell et al. | 208/238 |
| 2,519,587 | 8/1950 | McCaulay et al. | 200/223 |
| 2,739,102 | 3/1956 | Rylander | 208/238 |
| 2,912,374 | 11/1959 | Mazé | 208/224 |
| 3,340,184 | 9/1967 | Eng et al. | 208/238 |
| 3,943,227 | 3/1976 | Schutze et al. | 423/220 |
| 4,206,079 | 6/1980 | Frame | 252/428 |
| 4,207,173 | 6/1980 | Stansky | 208/207 |
| 4,284,818 | 8/1981 | Sato et al. | 568/323 |
| 4,290,913 | 9/1981 | Frame | 252/428 |
| 4,337,147 | 6/1982 | Frame | 208/206 |
| 4,440,870 | 4/1984 | Sanderson et al. | 502/207 |
| 4,775,462 | 10/1988 | Imai et al. | 208/189 |

*Primary Examiner*—Helane E. Myers

*Attorney, Agent, or Firm*—Thomas K. McBride; Eugene I. Snyder

[57] ABSTRACT

Hydrogen sulfide can be conveniently removed from streams containing up to about 1,000 ppm of $H_2S$ by reacting the latter with an olefin using a bed of an acidic solid catalyst in a non-oxidative process for the removal of hydrogen sulfide. The reaction can be effected under relatively mild conditions and is very selective for the removal of hydrogen sulfide without being attended by other unwanted reactions such as oligomerization, disproportionation, and skeletal rearrangement. Levels of hydrogen sulfide in the treated product of no more than about 5 ppm can be readily attained using a broad variety of acidic solid catalysts and unsaturated hydrocarbons, especially olefins.

19 Claims, No Drawings

NON-OXIDATIVE REMOVAL OF HYDROGEN SULFIDE FROM GASEOUS, PETROCHEMICAL, AND OTHER STREAMS

BACKGROUND OF THE INVENTION

The presence of substantial amounts of hydrogen sulfide in various streams, especially those arising from chemical and petrochemical plants and feedstocks, has required the development of suitable processes for its removal because hydrogen sulfide frequently is an undesirable contaminant for diverse reasons. The Claus process enjoys widespread usage in converting hydrogen sulfide to sulfur but suffers from inherent limitations, two of which are especially significant in the context of this application. One limitation results from its conversion efficiency in the range of 93–97%, as a consequence of which tailgas emissions still contain unacceptably high hydrogen sulfide levels, especially in view of air quality standards and goals. Another limitation results from economy of size which makes the Claus process commercially feasible only where large amounts of hydrogen sulfide are to be removed. The Claus process simply is not feasible for small streams, or for streams containing relatively low (not more than about 1,000 ppm) levels of hydrogen sulfide.

Several other processes have been developed for hydrogen sulfide removal from streams with lower levels of hydrogen sulfide, with those which have achieved some measure of commercial success being oxidative processes. See D. A. Dalrymple, T. W. Trofe, and J. M. Evans, *Chemical Engineering Progress*, March, 1989, pp. 43–49. The best known of these is the Stretford process which converts hydrogen sulfide to sulfur in a vanadium-based oxidation process using an oxygen transfer agent such as anthraquinone disulfonic acid to catalyze the oxidative regeneration of vanadium-(V) from vanadium-(IV). Like the Claus process, the Stretford process also has some inherent disadvantageous characteristics which severely limit its usefulness. Some of the hydrogen sulfide is converted to thiosulfate and sulfate salts rather than elemental sulfur. Discharge of these salts often is environmentally unacceptable, and the presence of significant vanadium levels merely exacerbates the problem; Dalrymple et al. have estimated disposal costs at $130–260 per kiloliter. The Stretford process is most easily used for gaseous streams and is not readily adaptable to liquid streams. In liquid phase streams the hydrogen sulfide usually is extracted with caustic solution with subsequent disposal of the caustic sulfide. With increasingly stringent environmental regulations caustic sulfide disposal is also becoming increasingly expensive and environmentally undesirable.

The hydrotreating of various petrochemical feedstocks generally leads to formation of hydrogen sulfide at levels necessitating its removal. As the amount of hydrotreated streams increases, as the environmental susceptibility to sulfates and thiosulfates increases, and as the demand for lower levels of hydrogen sulfide in various streams, especially petrochemical feedstocks, increases there is a more insistent and persistent demand for hydrogen sulfide removal from streams, both gaseous and liquid, in an environmentally benign manner. What seems particularly desirable is a non-oxidative method of hydrogen sulfide removal adaptable to a broad variety of hydrogen sulfide-containing streams.

Our invention is a non-oxidative method of hydrogen sulfide removal from gaseous or liquid streams, whether aqueous or non-aqueous, which converts hydrogen sulfide to mercaptan with subsequent removal of the mercaptan by art-recognized and environmentally neutral methods. The best example of the latter is the mild oxidation of mercaptan to disulfides which may remain in the stream as an innocuous contaminant or be removed from the original $H_2S$-containing stream by known methods. See R. A. Meyers, Handbook of Petroleum Refining Processes, McGraw-Hill Book Company, (1986), part 9. More recently we have developed a method of mercaptan removal which employs the addition of mercaptans to olefins to form thioethers, which also are generally innocuous contaminants; see U.S. Pat. No. 4,775,462. The invention within is somewhat related to the latter.

In greater particularity, our invention employs the reaction of hydrogen sulfide in hydrogen sulfide-containing streams with olefins to form mercaptans and, to a minor extent, thioethers. The formed mercaptans are converted to disulfides in an art-recognized and environmentally sound manner. The removal of hydrogen sulfide is efficient and applicable to both gas and liquid streams. Since prior art methods generally are not feasible for hydrogen sulfide removal from liquid streams, our invention fills a burgeoning industrial need. But since our process is adaptable to both gaseous and liquid feeds its versatility is economically beneficial. The method which is our invention is selective with respect to hydrogen sulfide removal, employs mild conditions where even relatively sensitive components remain unaffected, and routinely can attain residual hydrogen sulfide levels of 5 ppm or less.

SUMMARY OF THE INVENTION

The purpose of our invention is to remove hydrogen sulfide via a non-oxidative process from streams containing hydrogen sulfide at levels up to about 1,000 ppm. An embodiment of our invention comprises reacting the hydrogen sulfide with an olefin over a bed of an acidic solid catalyst to form a mercaptan. In a more specific embodiment the acidic solid catalyst which is used is a solid polyphosphoric acid. In a still more specific embodiment the solid catalyst is a zeolitic molecular sieve. In yet another embodiment the solid catalyst is a silicon-aluminum-phosphorus-oxide. In another aspect our invention comprises reacting the hydrogen sulfide in the stream with an olefin to form the mercaptan and subsequently oxidizing the mercaptan to a disulfide. Other embodiments will be apparent from the ensuing description.

DESCRIPTION OF THE INVENTION

The addition of hydrogen sulfide to olefins is a well-documented reaction which is employed in our invention to remove the hydrogen sulfide from streams in which it is present at a concentration of no more than about 1,000 ppm. The process which is our invention employs a bed of solid acidic catalyst to effect the addition of hydrogen sulfide to olefins under conditions which ensure very high conversion while simultaneously manifesting very high selectivity. For all practical purposes the addition of hydrogen sulfide to olefins, and to a quite minor extent the reaction of the formed mercaptans with yet another olefin molecule to form thioethers, is the sole reaction occurring in the practice of our invention.

The hydrogen sulfide-containing streams may be either aqueous or non-aqueous, and either gaseous or liquid. Examples of hydrogen sulfide-containing streams include natural gas, refinery and chemical plant fuel gases and sour off-gases, process and off-gas streams in coal gasification plants, geothermal vent gas, shale oil plant and underground coal gasification plant gases, Claus tail gas, enhanced oil recovery vent gas, syngas, LPG, and FCC off-gas, light straight run naphthas, FCC gasoline, and $C_3$–$C_5$ olefin streams used for alkylation, oligomerization, polymerization, and etherification. The particular nature of the hydrogen sulfide-containing stream is not important in the success of our invention so long as the stream contains no more than about 1,000 ppm hydrogen sulfide. In the more typical cases the stream will contain up to about 300 ppm hydrogen sulfide. Since in favorable cases our method can reduce $H_2S$ to under 1 ppm, the lower limit of $H_2S$ in streams treated by our invention is about 1 ppm, but in practice treatment generally will involve streams containing at least about 2 ppm, and more usually about 5 ppm hydrogen sulfide. Although our invention is applicable to both aqueous and non-aqueous streams the latter are the more typical streams which our invention will treat.

The hydrogen sulfide-containing stream is then reacted with an unsaturated hydrocarbon in the presence of an acidic solid catalyst at mercaptan-forming conditions. Although the unsaturated hydrocarbon may be a monoolefin, a polyolefin, or an alkyne, in practice it is most convenient to use an olefin as the unsaturated hydrocarbon, especially an olefin which forms a tertiary carbonium ion in the presence of an acidic catalyst. Many streams already will contain an olefin in sufficient amount and of an appropriate type to react with the hydrogen sulfide, but in those cases where the stream to be treated lacks an unsaturated hydrocarbon component one is conveniently added at some point prior to contact of the stream with the acidic solid catalysts. Examples of olefins which are effective in the practice of this invention include ethylene, propylene, the butenes (butene-1, butene-2, and 2-methylpropene or isobutylene), the pentenes, and especially 2-methyl-2-butene and 2-methyl-1-butene, the hexenes, FCC olefins, and any mixture thereof. By "FCC olefins" is meant a stream rich in olefins, especially propenes and butenes, which forms in the cracking, and especially fluid catalytic cracking, of petroleum feedstocks. Examples of olefins forming tertiary carbonium ions under acidic conditions include 2-methylpropene, 2-methyl-2-butene, and 2-methyl-1-butene, but in any event such olefins are sufficiently well known as to need no further elaboration.

In principle the unsaturated hydrocarbon need be present in only one molar proportion relative to the hydrogen sulfide to be removed. However, the higher the concentration of unsaturated hydrocarbon relative to hydrogen sulfide, the more facile is mercaptan formation. As a practical matter it is desired that there be present at least about 1.5 molar proportions of olefins. No upper limit of olefin or unsaturated hydrocarbon is imposed by considerations other than economic ones where the unsaturated hydrocarbon is to be added to the hydrogen sulfide-containing stream. A practical lower limit of unsaturated hydrocarbon present in the hydrogen sulfide-containing stream is about 0.01 weight percent.

An acidic solid catalyst is used in the practice of our invention, generally as a fixed bed. What is perhaps more important than the choice of a particular catalyst is the combination of catalyst and reaction conditions to assure selectivity of hydrogen sulfide addition relative to other reactions such as oligomerization, disproportionation, rearrangement, and so forth. One class of acidic solid catalyst which may be used in the practice of this invention consists of strong cation exchange resins having sulfonic acid groups. Such resins are essentially polymeric sulfonic acid resins which may be either micro-or macroreticular resins. To facilitate transport macroreticular resins are somewhat preferred, but whatever the precise nature of the resin such polymeric sulfonic acid resins acting as cation exchange resins are well known in the art and are readily available in many forms. Fluorosulfonic acid resins and polystyrene-based sulfonic acid resins are among the preferred resins.

Another class of acidic solid catalysts which may be used in the practice of this invention are strong mineral acids supported on solid catalysts, such as polyphosphoric acid, sulfuric acid, and boric acid supported on solids such as silica, alumina, silica-aluminas, or clays. These acid catalysts generally are prepared by impregnating the desired support with the desired liquid acid and thereafter drying the mass.

Acidic molecular sieves in general can serve as acceptable acidic solid catalysts in our invention, and include such materials as zeolitic molecular sieves, silicoaluminophosphates whether crystalline or amorphous, (SAPO's; see U.S. Pat. No. 4,440,870) and various natural and synthetic zeolites. Illustrative of such materials are faujasites, mordenites, L, omega, X and Y zeolites. ZSM-5, ZSM-11, SAPO-11, SAPO-34, and SAPO-11L.

Amorphous silica-aluminas and amorphous clays also may be used as catalysts. Among the clays may be mentioned attapulgite, montmorillonite, kaolinite, saponite, and beidellite. These clays may be used in their natural state or modified in an appropriate manner such as pillaring with cations such as Ce, Pr, Cr, Fe, Mg, and Ti to improve the acidity and selectivity for the desired reaction.

It is somewhat preferable to conduct the reaction between hydrogen sulfide and olefin in the liquid phase so long as the pressure requirements are modest. We emphasize that the process which is our invention may be carried out either in the gas or liquid phase, but our preference for convenience is a liquid phase reaction using a fixed bed of catalyst. By modest pressure requirements we mean pressures up to about 1500 pounds per square inch (psig), although we prefer to work at a pressure of no more than about 100 psig, and have an even greater preference for working at a pressure no greater than about 50 psig. But it needs to be emphasized again that pressure is used only for the purpose of working in the liquid phase and is not otherwise an important factor in the success of our invention.

The temperature at which the reaction is conducted is dependent upon the acidic solid catalyst used, as can be readily understood by the artisan. Nonetheless, temperatures generally will be in the range of from about 25° to about 200° C., with the range between 40° and about 100° C. favored. Our invention may be practiced as either a batch or a continuous process with the latter greatly favored. Although we are partial to the use of a fixed bed of catalyst, our invention may be equally well practiced using a fluidized bed, radial bed, ebullating bed, and so forth. The following description is illustrative for a continuous fixed bed process but other variants can be readily envisaged.

The hydrogen sulfide-containing stream, preferably in the liquid phase, is contacted with a fixed bed of catalyst in either an upflow or downflow mode. Where it is necessary or desirable to add an unsaturated hydrocarbon, its addition can be made at the start of the reaction zone but well before the fixed bed of catalyst to ensure that the unsaturated hydrocarbon is well dispersed in the hydrogen sulfide-containing stream prior to contact with the catalyst. The temperature in the reaction zone will be between 25° and about 200° C., normally between 40° and about 100° C. The weight hourly space velocity (WHSV) will depend upon the hydrogen sulfide content of the stream, the olefins available for reaction, and the particular catalyst used as well as reaction temperature, but typically will be between about 0.2 to about 20.

The effluent from the reactor zone as described above is a stream depleted in hydrogen sulfide and typically will have a hydrogen sulfide content less than about 5 ppm, usually under about 2 ppm, and often will be less than 1 ppm. The initial sulfide will have been converted predominantly to mercaptans with minor amounts of thioethers resulting from the subsequent reaction of the mercaptans to olefins. These mercaptans then can be removed by oxidative conversion to their disulfides by methods well known to the skilled worker. Such processes generally are based on an organometallic catalyst which promotes the oxidation of mercaptans to disulfides in an alkaline environment using air as the source of oxygen. Such a method is exemplified in U.S. Patents as, for example, U.S. Pat. Nos. 4,284,818, 4,290,913, 4,337,147, 4,206,079, and 4,207,173.

It also should be explicitly noted that the method of our invention is applicable to sour hydrocarbon streams (i.e., those containing mercaptans) containing hydrogen sulfide. Such streams may be first contacted with an acid catalyst in the presence of a suitable olefin to convert $H_2S$ to mercaptans, with the mercaptans then being extracted or the sour hydrocarbon stream sweetened in the conventional manner. In this way the currently conventional extraction of $H_2S$ prior to mercaptan oxidation or extraction is avoided, and a sulfidic-spent caustic stream in not generated. Avoidance of such caustic streams is quite desirable since their disposal presents vexing environmental problems not susceptible to inexpensive solution. Sour hydrocarbon streams include sour naphthas, LPG, FCC gasoline, FCC olefins, kerosenes, and diesel fuel. The applicability of our invention to sour $H_2S$-containing streams with attendant circumvention of sulfidic-spent caustic streams can not be overemphasized.

The following examples are only illustrative of our invention and should not be construed as limiting it in any way.

EXAMPLE I

Solid Polyphosphoric Acid as Catalyst

A solid polyphosphoric acid catalyst (40 cc) prepared from polyphosphoric acid and silica was loaded as a fixed bed into a reactor of ⅞-inch inside diameter. The reactor was maintained at 40° C. with a sand bath circulating heater and a stream of nitrogen was kept over the catalyst. A hydrocarbon feedstock consisting of approximately 50% benzene, 48% hexanes, and 2% 2-methyl-1-pentene and containing 454 ppm by weight (wppm) hydrogen sulfide and 72 wppm mercaptans was used as the feedstock. Feedstock was passed over the catalyst at 30 grams per hour (1 LHSV) at 100 psig (to ensure liquid phase conditions) at 40° C. The resulting product effluent was bottled under nitrogen and analyzed for both mercaptan and $H_2S$ with the results summarized in Table 1.

TABLE 1

| Removal of Hydrogen Sulfide with Supported Polyphosphoric Acid | | | |
|---|---|---|---|
| Time, | Product Analysis, wppm | | Percent $H_2S$ |
| minutes | Conc. $H_2S$ | Mercaptan | Conversion |
| 30 | 18 | 309 | 96.0 |
| 60 | 9 | 431 | 98.0 |
| 90 | 2 | 499 | 99.6 |
| 120 | 0 | 488 | 100.0 |
| 141 | 0 | 474 | 100.0 |

The foregoing results indicate essentially quantitative conversion of $H_2S$ to mercaptan at equilibrium.

EXAMPLE II

Polymeric Sulfonic Acid Resin as Catalyst

The catalyst used was a sulfonic acid resin (AMBERLYST 15 as supplied by Rohm and Haas) tested under conditions identical to those used in the foregoing example. The results shown in Table 2 show that this catalyst also is effective in reducing $H_2S$ concentrations, although clearly the catalyst is not as active as the solid polyphosphoric acid of the previous example. Suitable modifications of the reaction conditions, as by increasing the reaction temperature somewhat, will result in lowering $H_2S$ to a more acceptable level.

TABLE 2

| Removal of Hydrogen Sulfide with Polymeric Sulfonic Acid Resin. | | | |
|---|---|---|---|
| Time, | Product Analysis, wppm | | Percent $H_2S$ |
| minutes | Conc. $H_2S$ | Mercaptan | Conversion |
| 30 | 37 | 133 | 91.8 |
| 70 | 71 | 181 | 84.4 |
| 113 | 36 | 236 | 92.0 |

What is claimed is:

1. A method of reducing the hydrogen sulfide level in streams containing hydrogen sulfide at concentrations from about 2 ppm up to about 1,000 ppm comprising reacting the hydrogen sulfide with an unsaturated hydrocarbon in the presence of an acidic solid catalyst selected from the group consisting of polymeric sulfonic acid resins, solid polyphosphoric acid, supported sulfuric acid, supported boric acid, silica-aluminas, clays, faujasite, mordenite, and L, omega, X or Y zeolites at mercaptan-forming concentrations, and recovering a stream having a reduced hydrogen sulfide concentration and containing no more than 5 ppm hydrogen sulfide.

2. The method of claim 1 where the stream is selected from the group consisting of natural gas, refinery and chemical plant fuel gases and sour off-gases, process and off-gas streams in coal gasification plants, geothermal vent gas, shale oil plant and underground coal gasification plant gases, Claus tail gas, enhanced oil recovery vent gas, syngas, liquified petroleum and fluid catalytic cracking off-gas, light straight run naphthas, fluid catalytic cracking gasoline, and $C_3$–$C_5$ olefin streams.

3. The method of claim 2 where the stream is liquified petroleum gas, natural gas, $C_3$–$C_5$ olefins, Claus tail gas, fluid catalytic cracking off-gas, coal gasification off-gas, and straight-run naphtha.

4. The method of claim 1 where the unsaturated hydrocarbon is an olefin.

5. The method of claim 1 where the olefin is selected from the group consisting of fluid catalytic cracking olefins, ethylene, propylene, the butenes, the pentenes, and the hexenes, or any mixture thereof.

6. The method of claim 5 where the olefin is an fluid catalytic cracking olefin.

7. The method of claim 5 where the olefin is a butene.

8. The method of claim 7 where the olefin is 2-methylpropene.

9. The method of claim 5 where the olefin is 2-methyl-2-butene or 2-methyl-1-butene.

10. The method of claim 1 where the acidic solid catalyst is a polyphosphoric acid.

11. The method of claim 1 where the acidic solid catalyst is a clay selected from the group consisting of attapulgite, montmorillonite, kaolinite, saponite, and beidellite.

12. The method of claim 1 where the acidic solid catalyst is ZSM-5 or ZSM-11.

13. The method of claim 1 where the acidic solid catalyst is a silica-alumina-phosphorus oxide.

14. The method of claim 1 where the temperature is between about 40° and about 100° C.

15. The method of claim 1 where the mercaptan-forming conditions include a pressure sufficient to ensure that the hydrogen sulfide-containing stream is in the liquid phase.

16. The method of claim 15 where the pressure is up to about 1500 psig.

17. The method of claim 16 where the pressure is up to about 100 psig.

18. The method of claim 17 where the pressure is up to about 50 psig.

19. The method of claim 1 further characterized in that the mercaptans formed are oxidized to disulfides prior to recovery of the hydrogen sulfide-depleted stream.

* * * * *